US008727018B1

(12) United States Patent
McCulloch

(10) Patent No.: US 8,727,018 B1
(45) Date of Patent: May 20, 2014

(54) CHARGING UNIT, SYSTEM AND METHOD FOR ACTIVATING A WELLSITE COMPONENT

(71) Applicant: National Oilwell Varco, L.P., Houston, TX (US)

(72) Inventor: David W. McCulloch, Arlington, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/946,784

(22) Filed: Jul. 19, 2013

(51) Int. Cl.
*E21B 34/02* (2006.01)
*E21B 34/10* (2006.01)

(52) U.S. Cl.
USPC ..... 166/375; 166/72

(58) Field of Classification Search
USPC ..... 166/363, 368, 375, 72, 379; 60/413, 60/415
See application file for complete search history.

(56) References Cited

U.S. PATENT DOCUMENTS

| | | | | |
|---|---|---|---|---|
| 3,436,914 | A | 4/1969 | Rosfelder | |
| 3,669,151 | A | 6/1972 | Fleming | |
| 3,856,048 | A | 12/1974 | Gratzmuller | |
| 4,112,687 | A * | 9/1978 | Dixon | 60/641.6 |
| 4,777,800 | A | 10/1988 | Hay, II | |
| 4,923,008 | A * | 5/1990 | Wachowicz et al. | 166/373 |
| 5,474,304 | A * | 12/1995 | Daiber et al. | 277/500 |
| 5,846,028 | A * | 12/1998 | Thory | 405/195.1 |
| 6,192,680 | B1 * | 2/2001 | Brugman et al. | 60/398 |
| 6,202,753 | B1 | 3/2001 | Baugh | |
| 7,165,619 | B2 * | 1/2007 | Fox et al. | 166/343 |
| 7,367,396 | B2 | 5/2008 | Springett et al. | |
| 7,520,129 | B2 | 4/2009 | Springett | |
| 7,926,501 | B2 * | 4/2011 | Springett et al. | 137/14 |
| 8,156,953 | B2 * | 4/2012 | Tveita | 137/12 |
| 8,322,427 | B2 * | 12/2012 | Inderberg et al. | 166/336 |
| 8,464,525 | B2 * | 6/2013 | Springett et al. | 60/398 |
| 2006/0231265 | A1 * | 10/2006 | Martin | 166/365 |
| 2008/0257559 | A1 * | 10/2008 | Grimseth et al. | 166/375 |
| 2008/0267786 | A1 | 10/2008 | Springett et al. | |
| 2009/0194290 | A1 * | 8/2009 | Parks et al. | 166/339 |
| 2011/0114329 | A1 * | 5/2011 | Emecheta et al. | 166/350 |
| 2012/0197527 | A1 * | 8/2012 | McKay et al. | 702/6 |
| 2013/0118755 | A1 * | 5/2013 | Kotrla et al. | 166/363 |
| 2014/0000902 | A1 * | 1/2014 | Wolfe et al. | 166/361 |

FOREIGN PATENT DOCUMENTS

| | | |
|---|---|---|
| WO | 2012037173 | 3/2012 |

* cited by examiner

*Primary Examiner* — Daniel P Stephenson
(74) *Attorney, Agent, or Firm* — The JL Salazar Law Firm

(57) ABSTRACT

A charging unit, system and method are provided. The system includes an activation unit and a charging unit. The activation unit includes a pump unit, a pressure circuit with an unloader valve to selectively permit fluid to pass from the pump unit to the wellsite component, and an accumulator bank operatively connectable to the pressure circuit to store the fluid under pressure for passage to the wellsite component whereby the wellsite component is selectively activated. The charging unit includes a charging circuit operatively connectable to the pressure circuit to selectively receive the fluid from the pump unit, a charging accumulator operatively connectable to the charging circuit to store the fluid under pressure, and a pressure reducing valve operatively connectable to the charging circuit to selectively pass the fluid from the charging accumulator to the accumulator bank whereby an activation pressure of the fluid provided to the wellsite component is maintained.

34 Claims, 8 Drawing Sheets

CHARGING UNIT, SYSTEM AND METHOD FOR ACTIVATING A WELLSITE COMPONENT

BACKGROUND

This present disclosure relates generally to activation devices used in wellsite operations. More specifically, the present disclosure relates to activation devices, such as accumulators and chargers used therewith, for activating wellsite equipment, such as blowout preventers.

Various oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars (or tubular strings) may be provided in the wellbore for passing subsurface fluids to the surface. Wellheads may be positioned about the wellbore at a surface end thereof to connect the tubulars to surface equipment.

Land-based or offshore wellsites may be provided with various equipment to facilitate capture of fluid from the wellbore. For example, blowout preventers may be positioned about a tubular at the wellhead to sever and/or seal the wellbore in the event of a blowout. The blowout preventers may have rams to engage the tubular and prevent the passage of fluid therethrough. Examples of blowout preventers are provided in Patent/App. Nos. WO2012/037173 and U.S. Pat. No. 7,367,396, the entire contents of which are hereby incorporated by reference herein. Accumulators may be provided to activate the rams of the blowout preventers. Examples of accumulators are provided in U.S. Pat. No. 7,520,129 and 2008/0267786, the entire contents of which are hereby incorporated by reference herein.

SUMMARY

In at least one aspect the disclosure relates to a charging unit of a system for activating a wellsite component of a wellsite. The activation system includes an activation unit including a pump unit, a pressure circuit with an unloader valve to selectively permit the fluid to pass from the pump unit to the wellsite component, and an accumulator bank operatively connectable to the pressure circuit to store at least a portion of the fluid under pressure for passage to the wellsite whereby the wellsite component is selectively activated. The charging unit includes a charging circuit operatively connectable to the pressure circuit to selectively receive the fluid from the pump unit, a charging accumulator operatively connectable to the charging circuit to store at least a portion of the fluid received from the pump unit under pressure, and a pressure reducing valve operatively connectable to the charging circuit to selectively pass the fluid from the charging accumulator to the accumulator bank whereby an activation pressure of the fluid provided to the wellsite component is maintained.

The charging may include a check valve, a dump valve, a charging line operatively connectable to the pump unit and receiving fluid therefrom (the charging line may operatively connect the pump unit to the charging accumulator), an accumulator line that operatively connects the charging accumulator to the pressure reducing valve, a reducing line that operatively connects the pressure reducing valve to the accumulator bank, a dump line that operatively connects the pressure reducing valve to a dump tank, and/or a secondary dump line that operatively connects the pressure reducing valve to a charging line (the charging line may operatively connect to the pump unit to the charging accumulator). The wellsite component may be a blowout preventer comprising rams drivable by the charged fluid.

In another aspect the disclosure may relate to a system for activating a wellsite component of a wellsite having a wellbore penetrating a subterranean formation. The system includes an activation unit and a charging unit. The activation unit includes a pump unit, a pressure circuit comprising an unloader valve to selectively permit the fluid to pass from the pump unit to the wellsite component, and an accumulator bank operatively connectable to the pressure circuit to store at least a portion of the fluid under pressure for passage to the wellsite component whereby the wellsite component is selectively activated. The charging unit includes a charging circuit operatively connectable to the pressure circuit to selectively receive the fluid from the pump unit, a charging accumulator operatively connectable to the charging circuit to store at least a portion of the fluid received from the pump unit under pressure, and a pressure reducing valve operatively connectable to the charging circuit to selectively pass the fluid from the charging accumulator to the accumulator bank whereby an activation pressure of the fluid provided to the wellsite component is maintained.

The pump unit includes at least one pump and a power source and/or a dump tank. The accumulator bank includes a plurality of blowout preventer accumulators. The system also includes at least one pressure gauge. The pressure circuit includes an input line operatively connecting the pump unit to the unloader valve, a pump line operatively connecting the unloader valve to the accumulator bank, a dump line operatively connecting the pump line to a dump tank, a blowout preventer line operatively connecting the accumulator bank to the wellsite component, and/or a three-way valve operatively connecting the charging circuit to the accumulator bank and a dump tank.

The system may also include an activation valve operatively connected to the blowout preventer line, the activation valve selectively permitting the fluid to pass to the wellsite component for activation thereof, and/or a pilot line operatively connected to a charging line, the charging line operatively connectable to the pump unit and the charging unit, the pilot line selectively passing a pilot signal to the unloader valve upon detection of a predetermined pressure in the charging line. The unloader valve may have a pressure setting, may be operable between an open position and a closed position depending on the pressure setting, may have a pilot to detect pressure in the pressure circuit, the pilot sending a signal to the unloader valve when the detected pressure is outside the pressure range, and/or may have an open position in fluid communication with the charging circuit and a closed position in fluid communication with a dump tank. The unloader valve may be operable to the open position when a pressure in the pressure circuit is above the predetermined pressure range and the unloader valve operable to the closed position when a pressure in the pressure circuit is below the predetermined pressure range.

Finally, in another aspect, the disclosure relates to a method of activating a wellsite component of a wellsite having a wellbore penetrating a subterranean formation. The method involves selectively pumping fluid to the wellsite component via an activation unit (the activation unit comprising a pressure circuit and an accumulator bank), maintaining the fluid in the accumulator bank at a predetermined pressure by selectively charging the fluid in the activation unit with a charging unit (the charging unit operatively connected to the pressure circuit, and a charging circuit with a charging accumulator), and selectively activating the wellsite component by selectively permitting the fluid to pass from the activation unit to the wellsite component.

The method may also involve selectively dumping fluid from the pressure circuit and/or storing the fluid under pressure in at least one of the accumulator bank and the charging accumulator. The selectively pumping may involve passing the fluid from the pump unit to the accumulator bank when the fluid is below a predetermined pressure, passing the fluid from the pump unit through the charging circuit and to the accumulator bank when the fluid is below a predetermined pressure, and/or dumping the fluid from at least one of the activation unit and the charging unit when the fluid is above a predetermined pressure. The maintaining may involve selectively dumping the fluid from the charging unit, passing the fluid from the charging unit to the accumulator bank when the fluid is below a predetermined pressure, and/or be performed when the pump unit is off.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

DETAILED DESCRIPTION

Figure 1A:
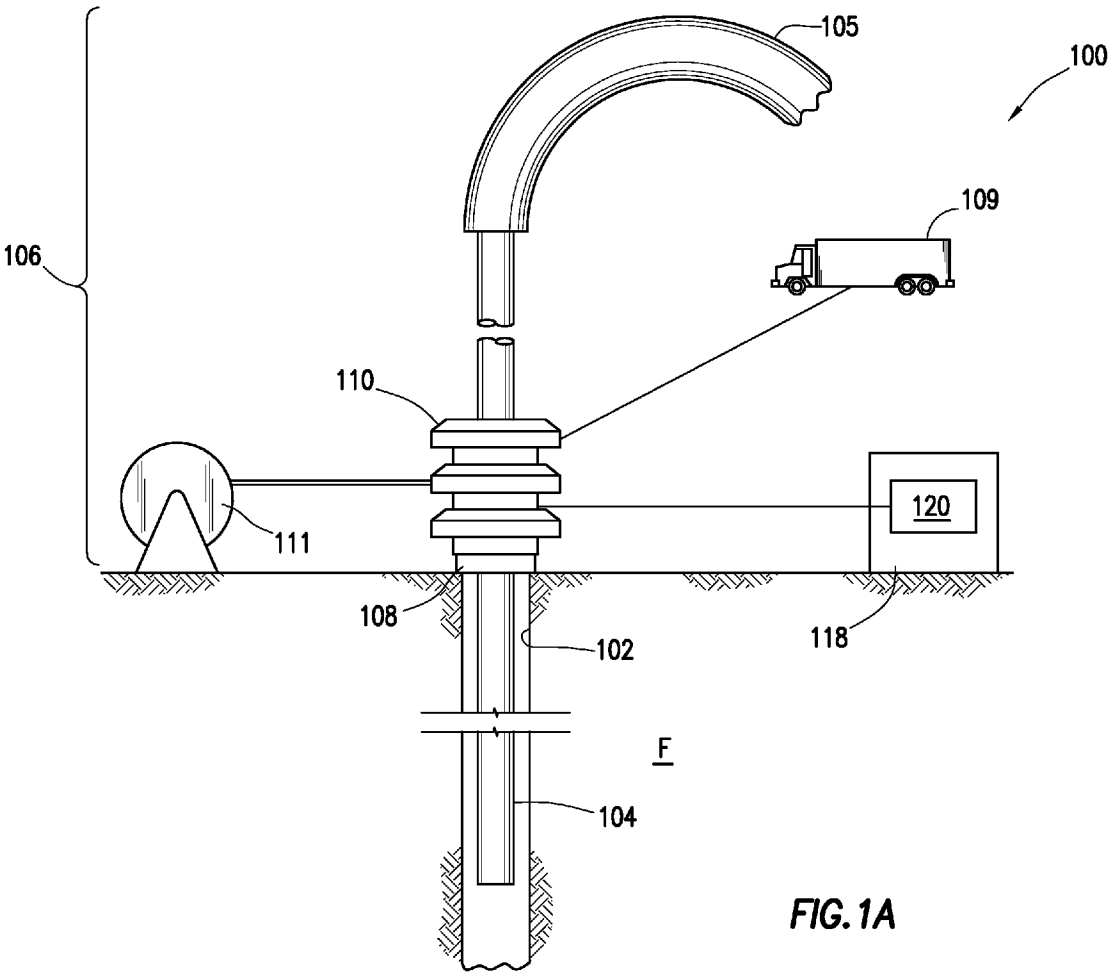
FIG. 1A is a schematic view of a wellsite having a blowout preventer with an activation system thereabout.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the subject matter. In addition, like or identical reference numerals may be used to identify common or similar elements.

An activation system for activating a wellsite component, such as a blowout preventer, is provided. The activation system includes an activation unit having one or more blowout preventer accumulators (BOP accumulators) and one or more pumps fluidly connected to the wellsite component by a fluid circuit for selectively applying pressure to the wellsite component for activation thereof. A charging unit is coupled to the activation unit for maintaining pressure in the activation system such that the BOP accumulators are maintained in a continuously pressurized mode for activation of the wellsite component. The charging unit may be provided with a charging accumulator and a pressure reducing valve to prevent a loss of pressure due to, for example, variations or interruption in operation of the pumps and/or BOP accumulators.

FIG. 1A depicts a wellsite 100 in which the subject matter of the present disclosure may be utilized. The wellsite 100 has a wellbore 102 extending into a subsurface formation F. A tubular 104 extends into the wellbore 102 to draw fluids from the formation F to the surface. Surface equipment 106 including a wellhead 108, a blowout preventer 110, and other wellsite components are positioned at the surface about the wellbore 102. The wellhead 108 is positioned about the wellbore 102 with the tubular 104 therethrough. Other wellsite components (or equipment or tools), such as coiled tubing 111, injectors/truck 109, crane 105, etc., may also be provided to perform other tasks, such as pumping fluid into and/or out of the wellbore 102.

Figure 1B:
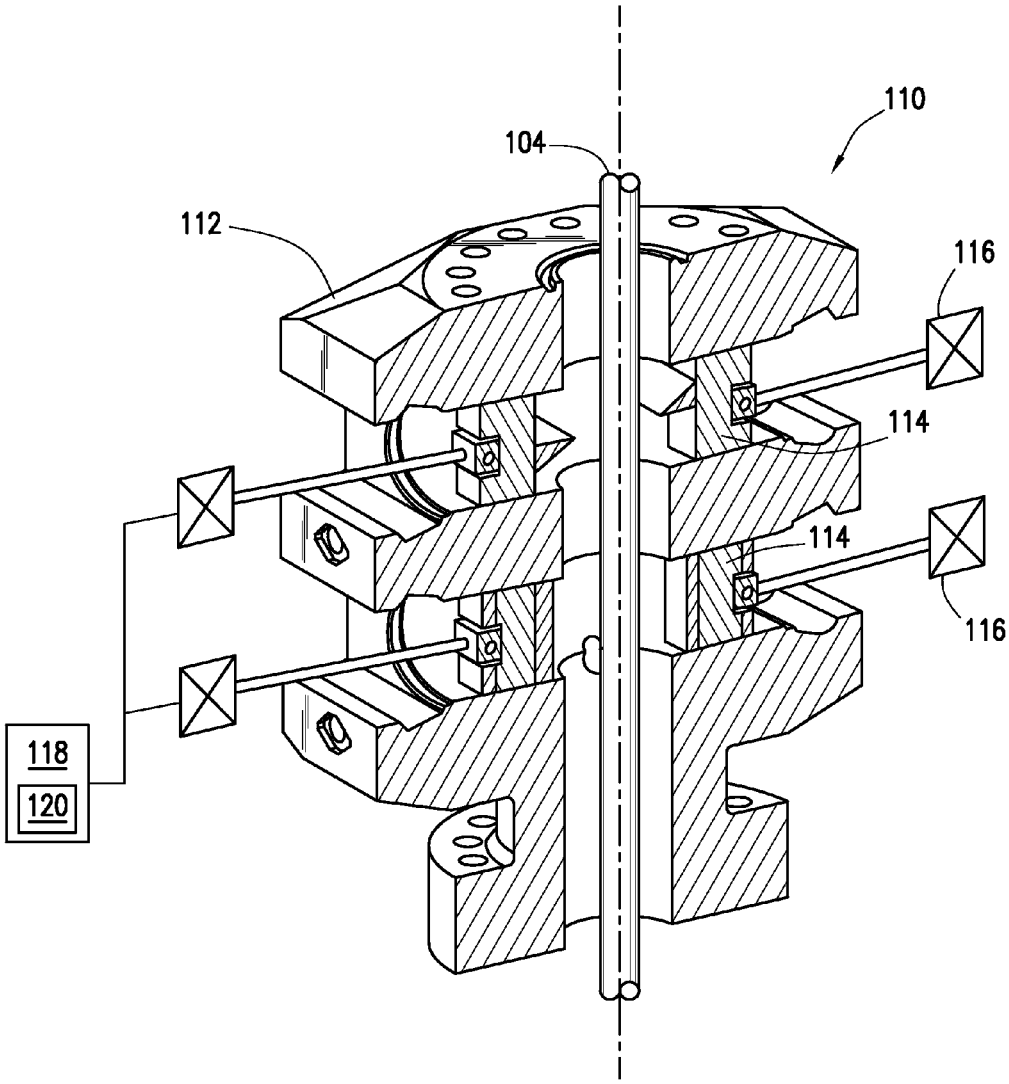
FIG. 1B is a detailed, schematic view of the blowout preventer having rams activatable by the activation system.

As shown in greater detail in FIG. 1B, the blowout preventer 110 includes a housing 112 with one or more sets of rams 114. The housing 112 of the blowout preventer 110 is positioned about the tubular 104 for selectively engaging the tubular 104. For example, the rams 114 are slidably positionable in the housing 112 for severing the tubular 104 and/or sealing the wellbore 102. Examples of blowout preventers 110 that may be used, include Patent/Application Nos. WO2012/037173 and U.S. Pat. No. 7,367,396, previously incorporated by reference herein.

The blowout preventer 110 has pistons 116 operatively connectable to the rams 114 for driving the rams 114 between a disengaged and an engaged position about the tubular 104. Stored hydraulic fluid under pressure may be used to actuate the rams 114. Sufficient pressure may be provided to activate the rams 114 to prevent a blowout when needed.

As schematically depicted in FIGS. 1A and 1B, a control unit 118 is operatively connected to the blowout preventer 110 for operation therewith. The control unit 118 includes an activation system 120 for selectively activating the rams 114 and/or blowout preventer 110. The activation system 120 may be, for example, a hydraulic or pressure driven device for providing sufficient pressure to selectively activate the blowout preventer pistons 116 that are operatively connected to and drive the rams 114. The control unit 118 may be charged to provide the desired pressure to activate the pistons 116 to drive the rams 114 into tubular engagement as is described further herein. The control unit 118 may have other devices, such as processors, computers, etc. for performing a variety of operations, such as data recording, equipment control, operator interaction, etc.

Figure 2:
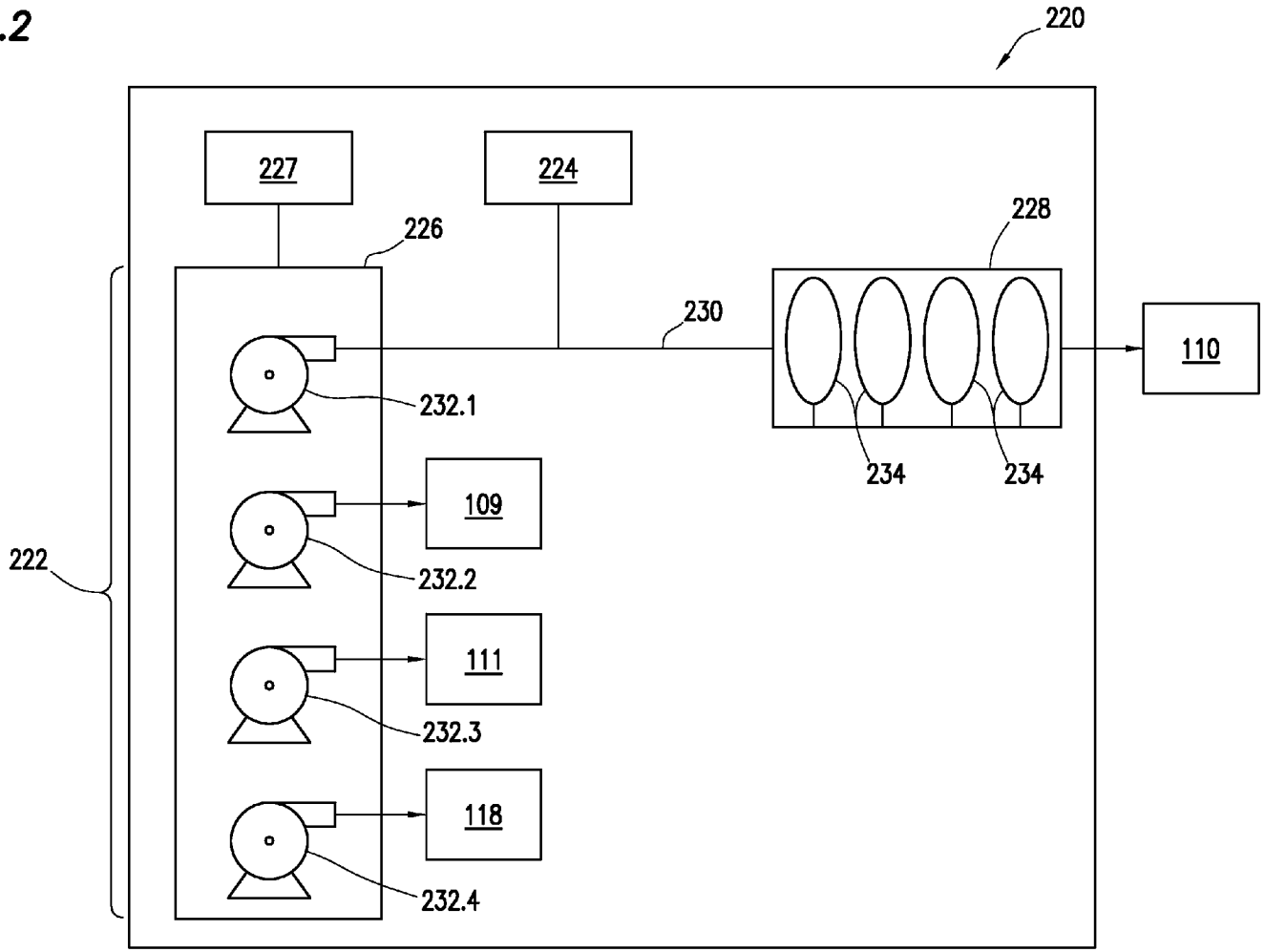
FIG. 2 is a schematic view of an activation system including an activation unit and a charging unit.

FIG. 2 shows an example activation system 220 usable as the activation system 120 for activating the blowout preventer 110 and/or other wellsite components (see, e.g., FIGS. 1A and 1B). The activation system 220 includes an activation unit 222 with a charging unit 224 operatively connected thereto. The activation unit 222, charging unit 224 and its components may be rated at a maximum operating pressure of the blowout preventer 110.

The activation unit 222 includes a pump bank 226 and an accumulator bank 228 for generating pressure to activate the blowout preventer 110. The pump bank 226 and accumulator bank 228 may operate, for example, like an air compressor to build pressure to a preset maximum and shut off until pressure drops to a preset minimum before turning back on. The activation unit 222 also includes a pressure circuit 230 operatively connecting the pump bank 226 and the accumulator bank 228 for fluid communication therebetween.

The pump bank 226 may include one or more pumps 232.1-232.4. One or more of the pumps 232.1-232.4 may be operatively connectable to various equipment, such as blowout preventer 110, injector 109, coiled tubing 111, and control unit 118 as shown in FIGS. 1A, 1B and/or 2, for pumping fluid thereto. In the example shown, four pumps 232.1-232.4 are connected to blowout preventer 110, injector 109, coiled tubing 111, and control unit 118, respectively, but other configurations may be provided. Pump 232.1 is operatively connectable to the blowout preventer 110 via the pressure circuit 230 and the accumulator bank 228 for applying fluid under pressure thereto. An engine (or other power source) 227 is provided to provide power to the pumps 232.1-232.4.

The accumulator bank 228 includes one or more BOP accumulators 234 (four are depicted). The accumulators used herein may be any accumulator capable of providing the desired pressure to the blowout preventer 110. By way of example, the accumulators may be bottles charged with nitrogen gas and capable of storing hydraulic fluid under pressure. Examples of accumulators are provided in U.S. Pat. No. 7,520,129 and 2008/0267786, previously incorporated by reference herein.

The BOP accumulators 234 are operatively connected to the pump 232.1 via pressure circuit 230 for receiving pressurized fluid therefrom. The BOP accumulators 234 are also operatively connected to blowout preventer 110 for selectively applying pressure from the pump 232.1 thereto. The application of pressure to the blowout preventer 110 is used to activate the blowout preventer 110 as is described more fully herein.

As also shown in FIG. 2, the charging unit 224 is operatively connectable to the activation unit 222 for operation therewith. The charging unit 224 may be used, for example, to maintain a constant pressure in case interruptions or variations in pressure occur in the activation system 220. For example, the pressure maintained by the charging unit 224 may be set at a maximum operating pressure of the blowout preventer 110 in case of loss of pressure.

The charging unit 224 is operatively connected to the pressure circuit 230 for selectively applying pressure thereto. The charging unit 224 is operatively connected to the accumulator bank 228 via the pressure circuit 230 to maintain pressure to the accumulator bank 228, even when pressure from the pump bank 226 may be unavailable.

In some cases, for example when power is cut from the activation system 220 (e.g., engine 227 is off), the pressure from the pump bank 226 may cease or be disrupted. The charging unit 224 may be provided to assure that a desired amount of pressure is applied to the accumulator bank 228. Should the pressure be insufficient or disrupted, the BOP accumulators 234 may be unable to apply pressure to the blowout preventer 110 when needed. The constant pressure provided by the charging unit 224 may be used to assure that the accumulator bank 228 has necessary pressure to activate the blowout preventer 110 whenever needed. The pressure provided may be within a pressure rating of the BOP accumulator(s) 234.

FIGS. 3A-3D depict an example activation system 320 in operation. The activation system 320 may be the same as the activation systems 120 of FIGS. 1A and 1B and/or 220 of FIG. 2. As shown in these figures, a pump unit 326 is operatively connected to an accumulator bank 328 by a pressure circuit 330. As also shown by these figures, the activation system 320 may be used to activate a wellsite component, such as blowout preventer 110. A charging circuit 324 may be operatively connected to the pressure circuit 330 to maintain pressure to the blowout preventer 110.

The pump unit 326 may be a bank of one or more pumps, such as the pump bank 226 of FIG. 2. As shown, the pump unit 326 includes a single pump 332 driven by a power source 327. The pump 332 may be, for example, a fixed or variable displacement pump capable of pumping, for example, at least about 3500 psi (246.13 kg/cm) through the pressure circuit 330. The pump 332 is schematically depicted as being connected by a shutoff valve 325 to a tank 362. As shown, the tank 362 may have a strainer 329 and a bypass 331 therein. The power source 327 may be an engine (e.g., 227 of FIG. 2), fluid and/or power source for driving the pump 332. Other devices may be provided to connect one or more pumps 332 (and/or a pump bank) to the pressure circuit 330.

The pressure circuit 330 includes a plurality of flowlines (or lines) and fluid control devices, such as valves for selectively passing fluid under pressure from pump unit 326 to the accumulator bank 328 and on to the blowout preventer 110. The accumulator bank 328 includes BOP accumulators 334 for receiving the fluid and accumulator gauge 335 for measuring pressure of the fluid. BOP accumulators 334 may be the same as the BOP accumulators 224 of FIG. 2. The BOP accumulators 334 may be provided with accumulator pressure set, for example, at about 3000 psi (210.97 kg/cm) or a predetermined pressure as needed for operation of the blowout preventer 110.

The pressure circuit 330 includes an input line 350 extending from the pump 332 to a first intersection 352. At the first intersection 352, an unloader valve 370 is provided to selectively fluidly couple the input line 350 to a charging line 354 or to a pumping line 356. The unloader valve 370 selectively couples the input line 350 to the charging unit 324, and the pumping line 356 couples the input line 350 to a second intersection 358.

The unloader valve 370 may be, for example, a valve capable of shifting between an open and closed position upon receipt of a pre-determined pressure. The unloader valve 370 may have pilot operated controls with a high flow poppet type seat valve controlled by a low flow, adjustable pilot. Upon receipt of a pilot signal outside a pre-determined pressure range, the unloader valve may be used to selectively open to unload pressure when an overpressure condition is detected or to close so that pressure may build when an under pressure condition is detected. Valves usable as the unloader valves are commercially available from DENISON HYDRAULICS™ (see: www.denisonhydraulics.com).

The unloader valve 370 may be selectively activated to turn on and/off as desired. The unloader valve 370 may be set, for example, to turn on (or open) or turn off (close) at a given pressure. For example, the unloader valve may open at about 3100 psi (281.00 kg/cm) and close at about 3500 psi (246.13 kg/cm). A gauge 372 is provided in the pumping line 350 to measure the pressure to determine activation of the unloader valve 370.

At the second intersection 358, the pumping line 356 couples to a dump line 360. Fluid from the pumping line 356 may optionally be selectively bypassed through a dump line 360 and out to tank 362 to release fluid. The flow through the unloader valve 370 and to the various lines may be adjusted based on pressure in the lines (e.g., charging line 354). Fluid may optionally be dumped from the dump line 360 out tank 362 as needed, for example, when power source 327 is off. The dump line 360 is fluidly coupled to a three-way valve 364. The three-way valve 364 may be used to passively permit the passage of fluid therethrough. An accumulator line 366 extends from the three-way valve 364 to the accumulator bank 328. A blowout preventer line 368 extends from the accumulator bank 328 to the blowout preventer 110. One or more actuator valves 367 may also be provided to selectively pass the fluid from the accumulator bank 328 to the blowout preventer 110. In an example, the actuator valve 367 releases fluid to the rams of the blowout preventer so that the rams may move to a sealed position to seal a wellbore (see, e.g., FIG. 1B).

Charging unit 324 is selectively fluidly coupled to the pressure circuit 330 by the unloader valve 370. The charging unit 324 includes a charging accumulator 374, a pressure reducing valve 376, and a charging circuit 378. The charging circuit 378 includes the charging line 354 to fluidly couple to the input line 350 at the first intersection 352. Fluid from the input line 350 may be used to charge the charging accumulator 374. The charging accumulator 374 may be set to a pressure higher than the accumulator bank 328, for example, using the pump 332 and unloader valve 370 (or a pressure compensating pump). The charging accumulator 374 may be set to store fluid under pressure in the charging circuit 378 to, for example, 5000 psi (351.62 kg/cm).

A check valve 380 may optionally be provided in the charging line 354 to prevent fluid from flowing back therethrough. As indicated by the dashed line, a pilot signal may be sent to the unloader valve 370 from the charging line 354 to shift the unloader valve 370 between the open and closed position at a given pressure in the charging line 354. When the unloader valve 370 is open, fluid flows to the charging circuit 378 along charging line 354.

The charging circuit 378 also includes a accumulator line 382 extending from the charging accumulator 374 through the pressure reducing valve 376 and to the three-way valve 364 at a third intersection 386 of the charging circuit 378. The charging accumulator 374 may be used to store fluid under pressure from the input line 350, and provide the pressurized fluid to the pressure reducing valve 376. The pressure reducing valve 376 may control the passage of pressurized fluid to the accumulator bank 328 to a desired pressure. The pressure reducing valve 376 may be used to set a maximum operating pressure, such as 3000 psi (281.00 kg/cm), to be maintained in the activation system 320. The pressure reducing valve 376 may be set, for example, to provide pressurized fluid through the accumulator line 382, to the three-way valve 364, and to the accumulator bank 328 at 3000 psi (281.00 kg/cm).

When the pressure reducing valve 376 is open, fluid from the accumulator line 382 is passed to the three-way valve 364. The fluid may freely pass through the three-way valve 364 and divert along accumulator line 366 to the accumulator bank 328. The accumulator bank 328 stores fluid under pressure for passage to the blowout preventer 110. Blowout preventer line 368 and actuator valves 367 may optionally be provided to selectively pass fluid from the accumulator bank 328 to the blowout preventer for activation thereof.

A reducing line 384 extends from the pressure reducing valve 376 to a fourth intersection 386. At the fourth intersection 386, return (or tank) lines, such as reducing line 384 and secondary dumping line 388 are provided. The pressure reducing valve 376 may also be set to divert fluid in line 382 through the pressure reducing valve 376, reducing line 384, dump line 360 and to dump tank 362, for example, when the pressure exceeds a maximum valve, such as 3000 psi (281.00 kg/cm).

The reducing line 384 is also fluidly coupled to the pumping line 356. A secondary dumping line 388 extends from the charging line 354 to the third intersection 386 for passing fluid back to charging line 354. The dump valve 390 is provided in the secondary dumping line 388 for dumping as needed, for example, during service.

Figure 3A:
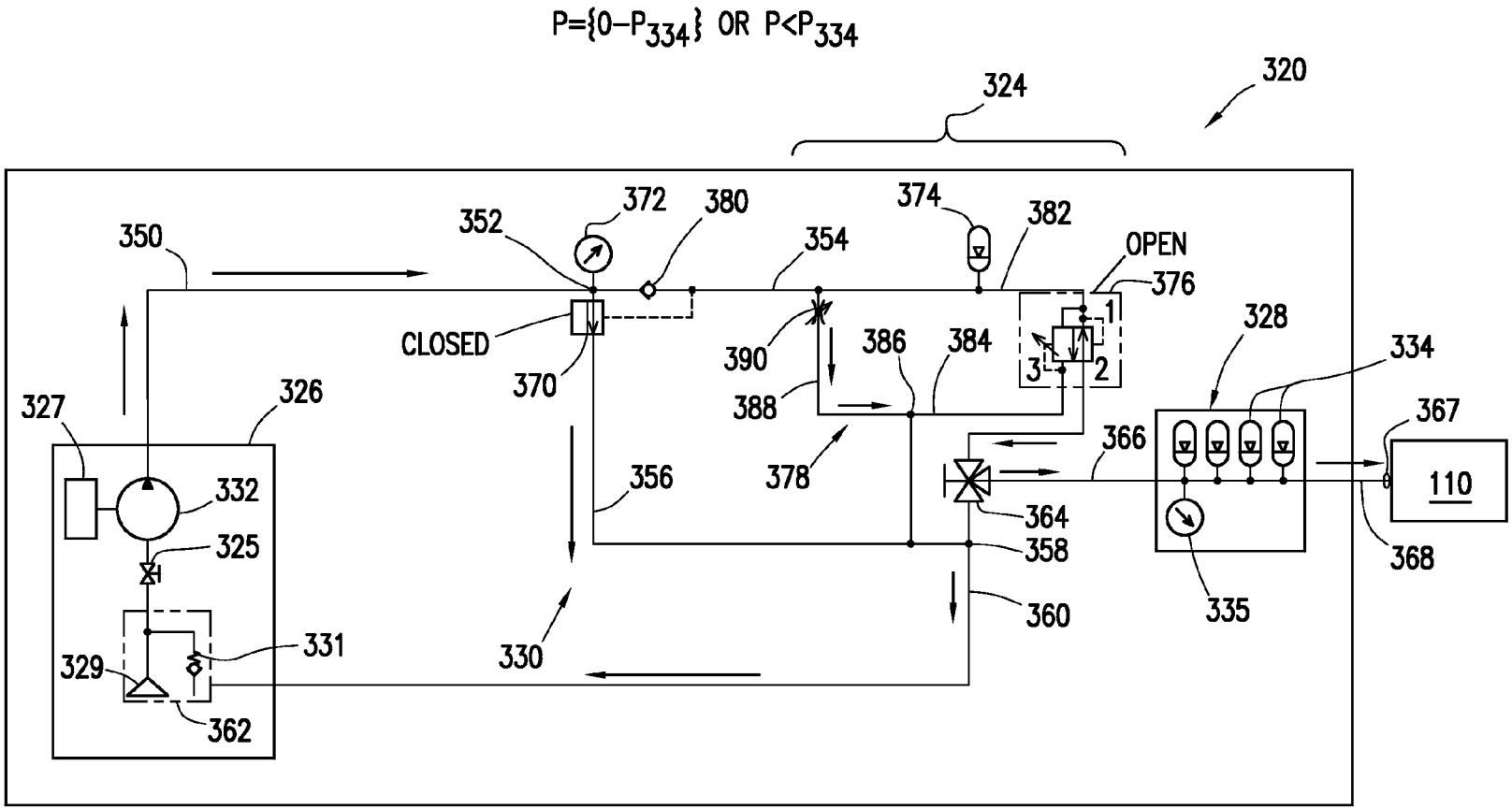
FIGS. 3A-3D are schematic views depicting operation of an activation system.

FIGS. 3A-3D also show an example operation using the activation system 320. In this example, fluid flows from pump unit 326 through the input line 350 and to the unloader valve 370 as shown in FIG. 3A. In an actuation mode of FIG. 3A, the pressure P read by gauge 372 is below the pressure P344 required by the BOP accumulators 334 (P<P344). At this pressure, the unloader valve 370 is closed and diverts fluid from input line 350 to the charging unit 324 along charging line 354. Fluid then passes to charging accumulator 374 for storage and on through pressure reducing valve 376.

At this pressure, the pressure reducing valve 376 remains open and permits fluid to pass from accumulator line 382 through three way valve 364 and on to the accumulator bank 328. Fluid may then pass from the accumulator bank 328 to the blowout preventer 110 for activation. As needed, fluid is permitted to pass into dump line 360 and dumped to tank 362.

Figure 3B:
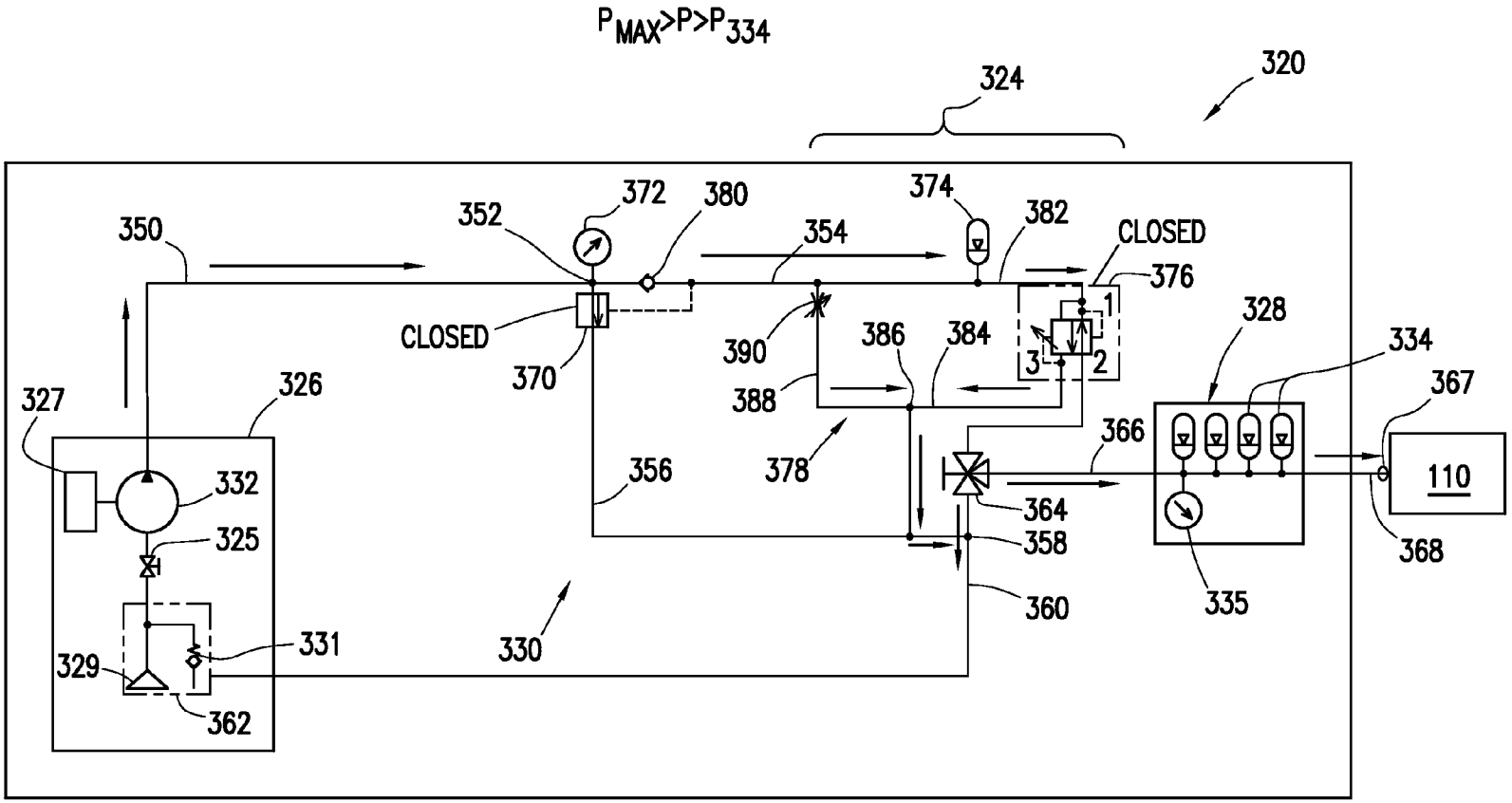

As shown in a bypass mode of FIG. 3B, once the pressure in gauge 372 reaches the pressure requirement (P334) of accumulators 334 (e.g., 3000 psi (281.00 kg/cm)), the unloader valve 370 remains closed so that fluid continues to flow from the pump unit 326 to the accumulator 374 through input line 350 and charging line 354. At the pressure requirement (P334), the pressure reducing valve 376 closes, so that fluid is diverted from accumulator line 382 to reducing line 384 and out dump line 360 to dump tank 362. Fluid continues to flow from the accumulator bank 328 to the blowout preventer 110 via actuator valves 367 for activation thereof. Fluid may continue to flow in this configuration until a maximum pressure Pmax of the unloader valve 370 is reached (P334<P<Pmax). If pressure drops below 3000 psi (281.00 kg/cm), then fluid may flow from pressure reducing valve 376 to the accumulator bank 328 and on to the blowout preventer 110 as in FIG. 3A.

Figure 3C:
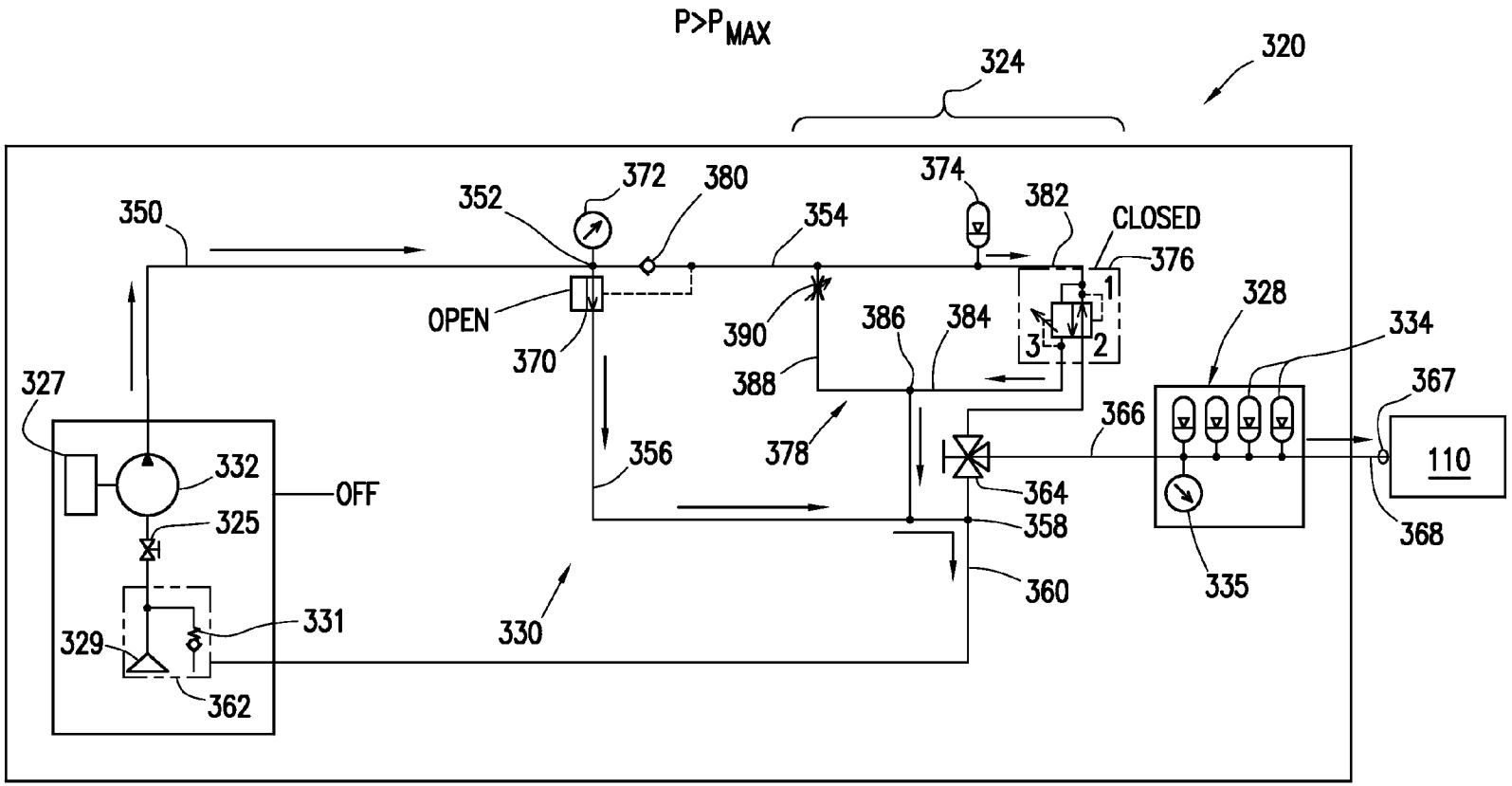

As shown in FIG. 3C, once the pressure in gauge 372 reaches Pmax (e.g., 4000 psi (281.00 kg/cm)), then the pump 332 may be shut off and unloader valve 370 may open to permit fluid to pass from input line 350 through pumping line 356, out dump line 360 and out to dump tank 362. Fluid may also be permitted to pass from the charging accumulator 374 through closed pressure reducing valve 376 out reducing line 384 and dump line 360 to the dump tank 362. This may continue while P>Pmax. Check valve 380 may be used to prevent back flow along line 354 from input line 350 to the charging circuit 378.

Figure 3D:
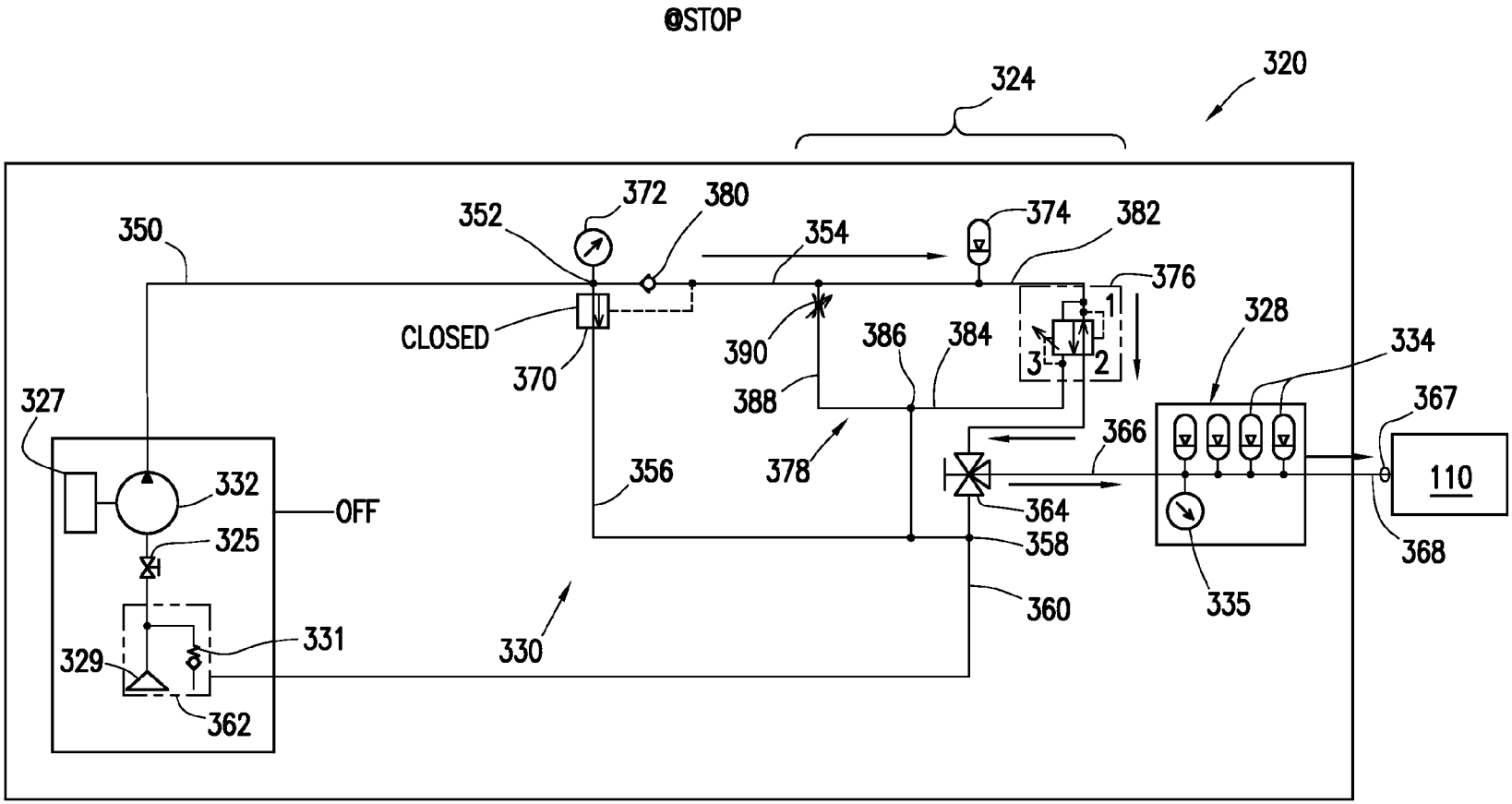

FIG. 3D shows the charging accumulator 374 supplying pressure to the accumulator bank 328 during a pressure loss in the pressure circuit 330. This may occur, for example, when the pump unit 326 loses power (e.g., engine 327 stops). In such cases, fluid from pump 332 and/or in the pressure circuit 330 may not flow. In this case, the unloader valve 370 may be open or closed. The charging accumulator 374 stores fluid at a pressure greater than a pressure of the accumulator bank 328. Thus, fluid may flow from the charging accumulator 374 through the open pressure reducing valve 376, through three-way valve 364 and on to the accumulator bank 328. This configuration may be used to maintain pressure in the accumulator bank even when fluid cannot be supplied by the pumping unit 326 at full rated pressure.

In some instances, such as when the engine is turned off, it may be necessary to dump fluid from the activation system 320. In such cases, fluid in the activation system 320 is permitted to pass from pumping line 356, through dump line 360 and out dump tank 362 as also shown in FIG. 3D.

The sequence of operation as shown in FIGS. 3A-3D may be varied. For example, the sequence may eliminate or repeat portions of the operation, and/or perform portions in any order.

Figure 4:
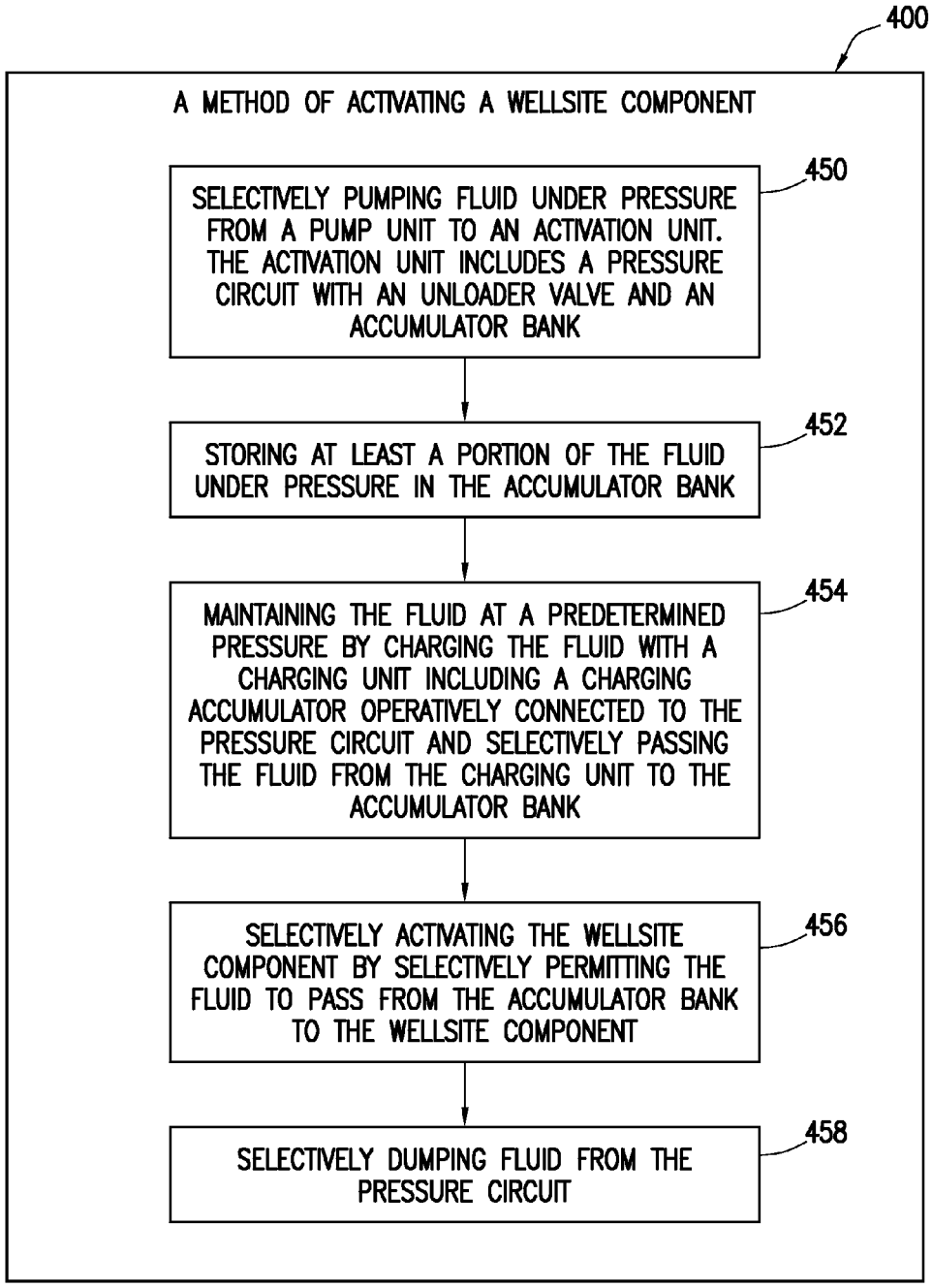
FIG. 4 is a flow chart depicting a method of activating a wellsite component.

FIG. 4 depicts a method 400 of activating a wellsite component of a wellsite having a wellbore penetrating a subterranean formation. The method involves (450) selectively pumping fluid under pressure from a pump unit to an activation unit. The activation unit includes a pressure circuit with an unloader valve and an accumulator bank. The method also involves (452) storing at least a portion of the fluid under pressure in the accumulator bank, (454) maintaining the fluid at a predetermined pressure by charging the fluid with a charging unit including a charging accumulator operatively connected to the pressure circuit and selectively passing the fluid from the charging unit to the accumulator bank, and (456) selectively activating the wellsite component by selectively permitting the fluid to pass from the accumulator bank to the wellsite component.

The selectively pumping (450) may involve passing the fluid from the pump unit through the unloader valve and to the accumulator bank when the fluid is within a predetermined pressure range, passing the fluid from the pump unit through the charging circuit and to the accumulator bank when the fluid is below a predetermined pressure, and/or dumping the fluid from at least one of the pressure circuit and the charging circuit when the fluid is above a predetermined pressure. The maintaining (454) may involve selectively dumping the fluid from the charging unit and/or passing the fluid from the charging unit to the accumulator bank. The maintaining (454) may be performed when the pump unit is off. The method may also involve selectively dumping (458) fluid from the pressure circuit.

The method may be performed in any order and repeated as desired.

While the subject matter has been described with respect to a limited number of embodiments, those skilled in the art, having benefit of this disclosure, will appreciate that other embodiments can be devised which do not depart from the scope of the subject matter as disclosed herein. Accordingly, the scope of the invention should be limited only by the attached claims.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more valves, accumulators, flowlines, fluid control devices and other components may optionally be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A charging unit of a system for activating a wellsite component of a wellsite, the activation system comprising an activation unit comprising a pump unit, a pressure circuit comprising an unloader valve to selectively permit fluid to pass from the pump unit to the wellsite component, and an accumulator bank operatively connectable to the pressure circuit to store at least a portion of the fluid under pressure for passage to the wellsite component whereby the wellsite component is selectively activated, the charging unit comprising:

a charging circuit operatively connectable to the pressure circuit to selectively receive the fluid from the pump unit;

a charging accumulator operatively connectable to the charging circuit to store at least a portion of the fluid received from the pump unit under pressure; and a pressure reducing valve operatively connectable to the charging circuit to selectively pass the fluid from the charging accumulator to the accumulator bank whereby an activation pressure of the fluid provided to the wellsite component is maintained.

2. The charging unit of claim 1, wherein the charging circuit comprises a check valve.

3. The charging unit of claim 1, wherein the charging circuit comprises a dump valve.

4. The charging unit of claim 1, wherein the charging circuit comprises a charging line operatively connectable to the pump unit and receiving the fluid therefrom.

5. The charging unit of claim 4, wherein a charging line operatively connects the pump unit to the charging accumulator.

6. The charging unit of claim 1, wherein the charging circuit comprises an accumulator line that operatively connects the charging accumulator to the pressure reducing valve.

7. The charging unit of claim 1, wherein the charging circuit comprises a reducing line that operatively connects the pressure reducing valve to the accumulator bank.

8. The charging unit of claim 1, wherein the charging circuit comprises a dump line that operatively connects the pressure reducing valve to a dump tank.

9. The charging unit of claim 1, wherein the charging circuit comprises a secondary dump line that operatively connects the pressure reducing valve to a charging line, the charging line operatively connects the pump unit to the charging accumulator.

10. The charging unit of claim 1, wherein the wellsite component is a blowout preventer comprising rams drivable by the charged fluid.

11. A system for activating a wellsite component of a wellsite having a wellbore penetrating a subterranean formation, the system comprising:

an activation unit comprising;

a pump unit;

a pressure circuit comprising an unloader valve to selectively permit fluid to pass from the pump unit to the wellsite component; and an accumulator bank operatively connectable to the pressure circuit to store at least a portion of the fluid under pressure for passage to the wellsite component whereby the wellsite component is selectively activated;

a charging unit, comprising:

a charging circuit operatively connectable to the pressure circuit to selectively receive the fluid from the pump unit;

a charging accumulator operatively connectable to the charging circuit to store at least a portion of the fluid received from the pump unit under pressure; and a pressure reducing valve operatively connectable to the charging circuit to selectively pass the fluid from the charging accumulator to the accumulator bank whereby an activation pressure of the fluid provided to the wellsite component is maintained.

12. The system of claim 11, wherein the pump unit comprises at least one pump and a power source.

13. The system of claim 11, wherein the pump unit comprises a dump tank.

14. The system of claim 11, wherein the accumulator bank comprises a plurality of blowout preventer accumulators.

15. The system of claim 11, further comprising at least one pressure gauge.

16. The system of claim 11, wherein the pressure circuit comprises an input line operatively connecting the pump unit to the unloader valve.

17. The system of claim 11, wherein the pressure circuit comprises a pump line operatively connecting the unloader valve to the accumulator bank.

18. The system of claim 11, wherein the pressure circuit comprises a dump line operatively connecting the pump line to a dump tank.

19. The system of claim 11, wherein the pressure circuit comprises a blowout preventer line operatively connecting the accumulator bank to the wellsite component.

20. The system of claim 19, further comprising an activation valve operatively connected to the blowout preventer line, the activation valve selectively permitting the fluid to pass to the wellsite component for activation thereof.

21. The system of claim 11, further comprising a pilot line operatively connected to a charging line, the charging line operatively connectable to the pump unit and the charging unit, the pilot line selectively passing a pilot signal to the unloader valve upon detection of a predetermined pressure in the charging line.

22. The system of claim 11, wherein the pressure circuit further comprises a three-way valve operatively connecting the charging circuit to the accumulator bank and a dump tank.

23. The system of claim 11, wherein the unloader valve has a pressure setting, the unloader valve operable between an open position and a closed position depending on the pressure setting.

24. The system of claim 11, wherein the unloader valve has a pilot to detect pressure in the pressure circuit, the pilot sending a signal to the unloader valve when the detected pressure is outside a pre-determined pressure range.

25. The system of claim 24, wherein the unloader valve has an open position in fluid communication with the charging circuit and a closed position in fluid communication with a dump tank, the unloader valve operable to the open position when a pressure in the pressure circuit is above the predetermined pressure range and the unloader valve operable to the closed position when a pressure in the pressure circuit is below the predetermined pressure range.

26. A method of activating a wellsite component of a wellsite having a wellbore penetrating a subterranean formation, the method comprising:

selectively pumping fluid to the wellsite component via an activation unit, the activation unit comprising a pressure circuit and an accumulator bank;

maintaining the fluid in the accumulator bank at a predetermined pressure by selectively charging the fluid in the activation unit with a charging unit, the charging unit operatively connected to the pressure circuit, the charging unit comprising a charging circuit with a charging accumulator; and selectively activating the wellsite component by selectively permitting the fluid to pass from the activation unit to the wellsite component.

27. The method of claim 26, further comprising selectively dumping the fluid from the pressure circuit.

28. The method of claim 26, wherein the selectively pumping comprises passing the fluid from a pump unit to the accumulator bank when the fluid is below a predetermined pressure.

29. The method of claim 26, wherein the selectively pumping comprises passing the fluid from a pump unit through the charging circuit and to the accumulator bank when the fluid is below a predetermined pressure range.

30. The method of claim 26, wherein the selectively pumping comprises dumping the fluid from at least one of the activation unit and the charging unit when the fluid is above a predetermined pressure range.

31. The method of claim 26, wherein the maintaining further comprises selectively dumping the fluid from the charging unit.

32. The method of claim 26, wherein the maintaining comprises passing the fluid from the charging unit to the accumulator bank when the fluid is below a predetermined pressure.

33. The method of claim 26, wherein the maintaining is performed when a pump used for the selectively pumping is off.

34. The method of claim 26, further comprising storing the fluid under pressure in at least one of the accumulator bank and the charging accumulator.

* * * * *